United States Patent [19]

Olmr

[11] 4,348,927

[45] Sep. 14, 1982

[54] SAFETY SAW CHAIN

[75] Inventor: Jaroslav J. Olmr, Columbia, S.C.

[73] Assignee: Textron Inc., Providence, R.I.

[21] Appl. No.: 216,150

[22] Filed: Dec. 15, 1980

[51] Int. Cl.[3] ..... B27B 33/14

[52] U.S. Cl. ..... 83/833; 83/834; 83/830

[58] Field of Search ..... 83/830, 833, 834

[56] References Cited

U.S. PATENT DOCUMENTS 3,951,027 4/1976 Arff ..... 83/834

FOREIGN PATENT DOCUMENTS 619823 5/1961 Canada ..... 83/834

196274 5/1967 U.S.S.R. ..... 83/833

*Primary Examiner*—Donald R. Schran

*Attorney, Agent, or Firm*—Webb, Burden, Robinson & Webb

[57] ABSTRACT

An improved, endless safety saw chain includes a pair of side links, one of the side links being a cutter link and the other of the side links being a noncutting link and having a depth gauge in substantial alignment with a depth gauge on the cutter link. A preceding center drive link may include an upward and rearward sloping surface positioned to extend between the depth gauges of the side links. The sloping surface is preferably dimensioned so as to be in substantial alignment with the depth gauges as the saw chain articulates about the nose of the chain saw bar.

9 Claims, 9 Drawing Figures

SAFETY SAW CHAIN

FIELD OF THE INVENTION

My invention relates to saw chains and, more particularly, to safety saw chains utilizing a plurality of interacting, sloped surfaces to increase the facial area of the depth gauge and reduce kickback while maintaining the chain's ability to bore and otherwise cut.

DESCRIPTION OF THE PRIOR ART

It has been recognized heretofore that the depth gauge contour can be a factor in causing kickback of the saw chain during operation. For many years loggers have filed the depth gauges to assure a rearwardly sloping surface to provide a smoother action as the cutter link passes through the wood. It has also been recognized that depth gauge setting is a factor effecting kickback with the greater the cutting bite the greater the chance of kickback. Attempts have been made to control the contour of the depth gauge and patents such as U.S. Pat. Nos. 3,548,897 and 3,929,049 so recognize this feature.

It has also been recognized that a drive link preceding the cutter link can include a rearward sloping surface to protect the depth gauge by providing a ramped surface for engagement with twigs and branches. Exemplary of the patents which include protective surfaces on the drive link for one reason or another are U.S. Pat. Nos. 3,180,378, 4,133,239, 3,910,148, 2,963,055 and 3,951,027. Others have attempted to use various combinations of links with a noncutting side link including the depth gauge, U.S. Pat. No. 2,989,096.

Despite the previous attempts to reduce kickback, the problem remains and is of increasing importance as more inexperienced and nonprofessional users purchase chain saws. The addition of protective links in a chain saw not only can affect the cutting efficiency, but can drastically affect the boring performance of a saw chain, which performance is necessary under certain cutting conditions. Safety is likewise a problem to the professional users and a reduction in kickback is a desired result.

SUMMARY OF THE INVENTION

I have developed a new safety chain having an increased facial area on the depth gauge resulting in greatly reduced kickback. The reduction in kickback energy has been accomplished without any sacrifice in the boring capability of the chain. Other cutting criteria such as cutting efficiency have not been sacrificed. Further, my new safety chain operates on a regular sprocket nose bar whereas many of the specially designed safety chains must run on specially built, small radius nose bars.

My safety saw chain includes center links pivotally joined to pairs of side links with certain of the pairs of side links being cutter pairs. The cutter pairs include a noncutting tie link on one side of the chain and a cutter link on the other side of the chain. Both the noncutting tie link and the cutter link include depth gauges of comparable profile positioned in side by side relationship. A center link, preferably a drive link, preceding the cutter pair may include an upwardly and rearwardly sloping surface positioned to extend between the depth gauges of the noncutting tie link and the cutter link when the chain is in a flat position. The sloping surface preferably assumes the profile of the other two depth gauges as the saw chain articulates about the nose of the saw bar. A gullet is provided below the peak of the upwardly and rearwardly sloping surface to align with the gullets formed adjacent the depth gauges to permit sharpening of the cutter link.

DESCRIPTION OF THE PREFERRED EMBODIMENTS

Figure 1:
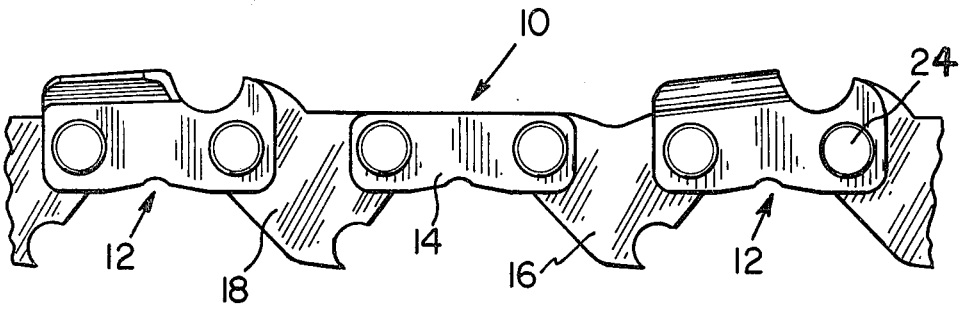
FIG. 1 is a side elevation of a section of saw chain including my invention.

My saw chain, generally designated 10, provides a depth gauge means having an increased facial area which minimizes or prevents the depth gauge from burrowing into the wood being cut. This facial area is the portion or surface of the depth gauge that engages the wood to control the depth of cut of the cutter link. The general arrangement of the saw chain includes a cutter pair 12 pivotally connected to a drive link 18 having an upwardly and rearwardly sloped surface, a pair of tie straps 14 pivotally connected to the drive link 18, a standard drive link 16 pivotally connected to the tie straps 14 and a preceding cutter pair 12 pivotally connected thereto with the cutter link of the preceding cutter pair being in allochiral relationship to the first described cutter pair, i.e. one cutter link being a left handed cutter and the next cutter link being a right handed cutter in alternating sequence, FIG. 1.

Figure 2:
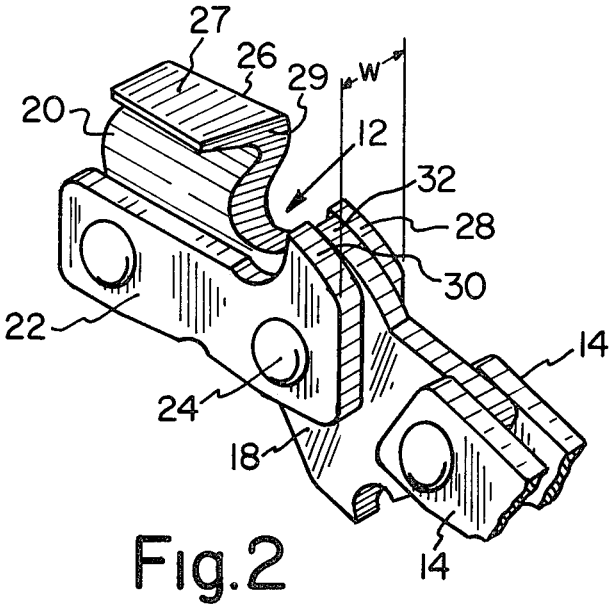
FIG. 2 is a perspective view showing the interaction of the cutting pair and preceding drive link.
Figure 3:
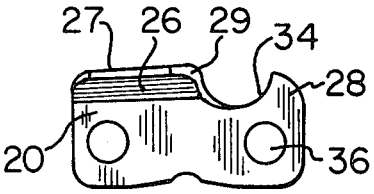
FIG. 3 is a side elevation of the cutting link.

In the preferred embodiment, I have provided a plurality of depth gauges in side by side relationship resulting in a facial area substantially equal to the width W of the saw chain, FIG. 2. While a single depth gauge could be configured to extend the width of the chain, I found that employing a plurality of depth gauges permits the use of more conventional type chain links. The cutter pair 12 comprises a cutter link 20 assembled in side by side relationship with a cutter tie strap 22, FIGS. 2 and 7. Cutter link 20 includes two rivet holes 36 in a base portion thereof, FIG. 3. A cutting portion 26 formed by a top plate 27 and a leading cutting edge 29 extend upward from the base portion of the cutter link 20. Forward of the cutting portion 26 and spaced therefrom by gullet 34 in depth gauge 28, FIGS. 3 and 7. Depth gauge 28 has an upwardly and rearwardly sloped contour not unlike known depth gauge contours. Test results discussed in more detail at the conclusion of the specification evidence that increased facial area of the nonrearwardly sloping depth gauges likewise provides a substantial reduction in kickback.

Figure 4:
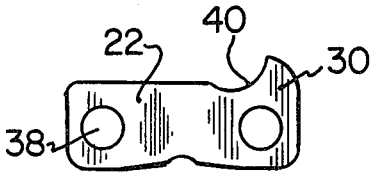
FIG. 4 is a side elevation of the noncutting tie link.

The cutter tie strap 22, which also makes up a part of the cutter pair 12 includes two rivet holes 38 and a depth gauge 28 along its forward end, FIG. 4. Rearward of the depth gauge 28 is a gullet 40. The depth gauges 30 and 28 and gullets 40 and 34 of the cutter tie strap 22 and the cutter link 20, respectively, are dimensioned to provide a common profile in the assembled position.

Figure 6:
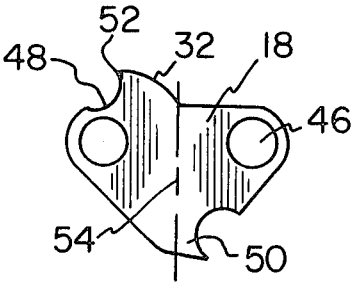
FIG. 6 is a side elevation of a drive link with the sloping surface.
Figure 7:
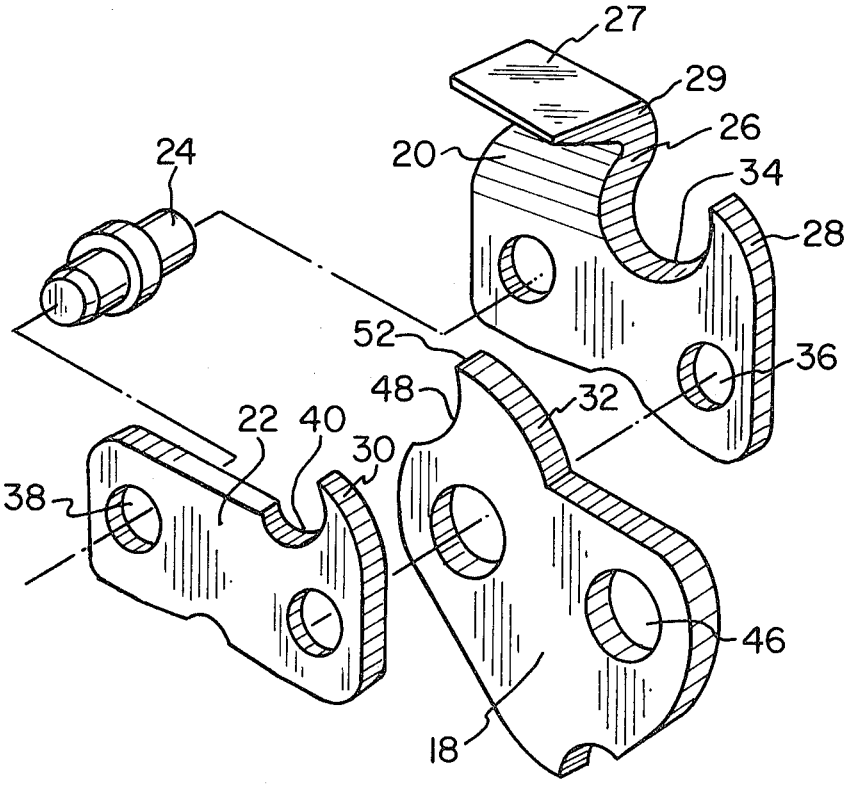
FIG. 7 is an exploded view of the saw chain components illustrated in FIG. 2.

The forward rivet holes of the cutter tie strap 22 and the cutter link 20 are in alignment with the rear rivet hole 46 of center drive link 18 so that the center drive link spaces the cutter tie strap 22 from cutter link 20, FIGS. 2 and 7. Drive link 18 includes a drive tang 50 for sliding engagement with a groove in a chain bar and for mating engagement with an appropriate socket drive means (not shown), FIG. 6. Drive link 18 includes along its upper surface a rearwardly and upwardly sloping surface 32 terminating in a peak 52. Positioned below peak 52 a gullet 48 is formed to align with gullets 30 and 40 and accommodate a sharpening tool such as a file in the assembled position.

Sloping surface 32 initiates at approximately the vertical center line 54 of the drive link 18, FIG. 6. In the assembled position, the peak 52 of sloped surface 32 is slightly below the peak of the depth gauges 30 and 28 when the chain is running on the flat portion of the bar, FIG. 2. In the same position, the slope of the surface 32 is slightly more gradual than the slope of depth gauges 30 and 28. The peak 52 and the slope of surface 32 are dimensioned so that when the chain is going around the nose of the bar the profile of the surface 32 of the drive link 18 assumes a profile similar to that of the depth gauges 30 and 28. This provides the most favorable interaction of the depth gauges in the upper quadrant of the nose of the bar where the potential for kickback is the greatest.

Figure 5:
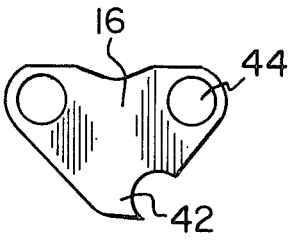
FIG. 5 is a side elevation of a drive link without the sloping surface.

The drive link 16, without an upwardly and rearwardly sloping surface, FIG. 5, pivotally connects through the rear rivet holes of the cutter tie strap 22 and cutter link 20 and is of the standard type having two rivet holes 44 and a drive tang 42. Rivets 24 retain the various links of the chain in assembled relationship.

Figure 8:
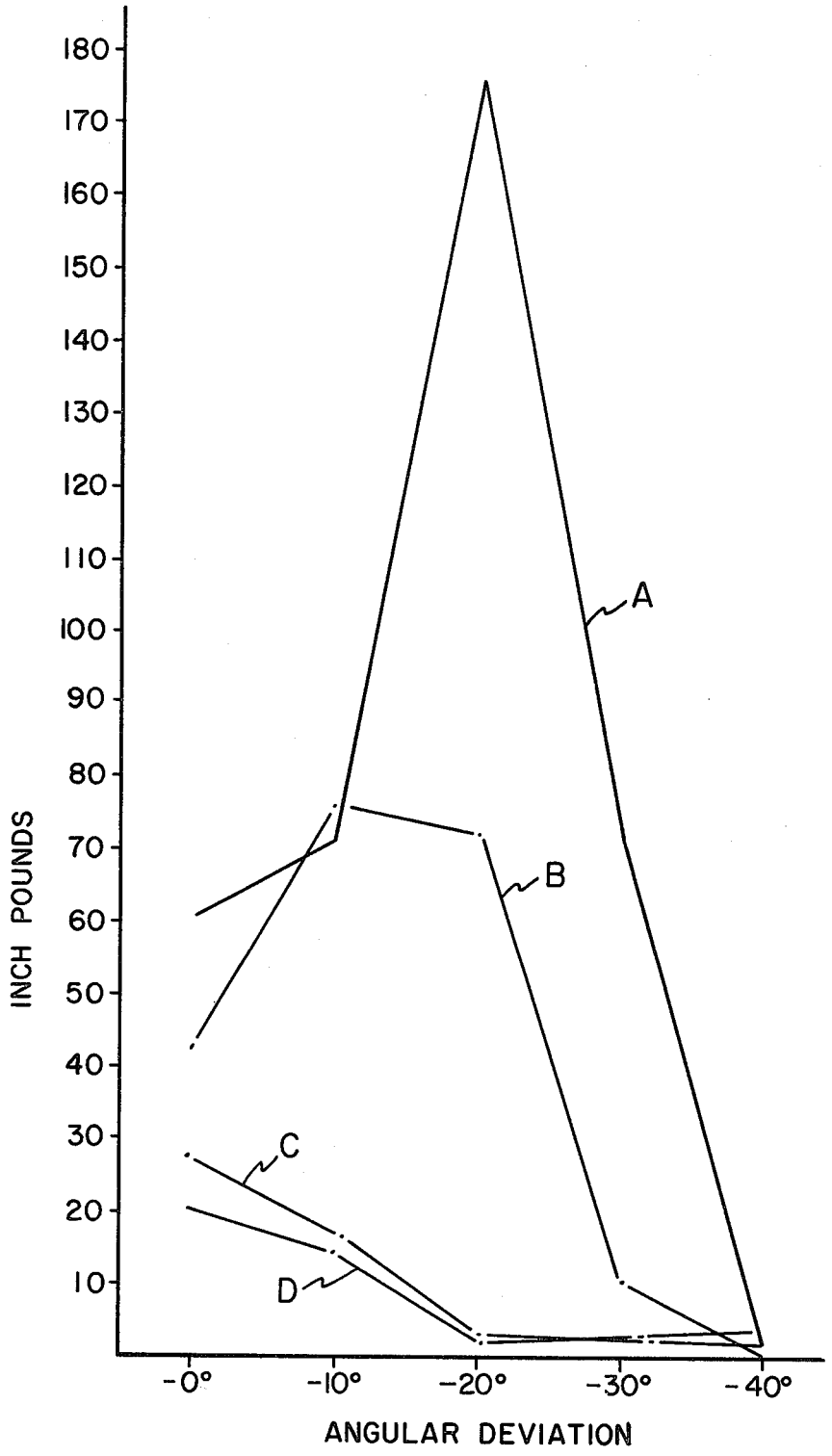
FIG. 8 is a graph showing kickback results with my saw chain.

A series of comparative kickback tests have been performed with my chain and with a standard low profile $\frac{3}{8}$ inch pitch chain in present use on consumer chain saws. The low profile $\frac{3}{8}$ inch pitch chain has a single depth gauge on the cutter link and no other elements are present to act as or to protect the depth gauge. These kickback results are illustrated in FIG. 8. The tests were conducted on a kickback machine of the type developed by the Chain Saw Manufacturers Association and recently adopted by the Consumer Product Safety Commission. Such a machine presently exists in the National Bureau of Standards. The various chains were operated at 10,000 rpm with a depth gauge setting of 0.020 inch.

The absicca of the curve represents the angular deviation of the chain and the bar with 0° representing the horizontal position. The ordinate of the curve represents the inch pounds of energy or more accurately the inch pounds of energy measured from the rebound of the bar and chain.

Curve A represents the kickback from the low profile $\frac{3}{8}$ inch pitch chain run on a standard sprocket nose bar. Curve B represents a standard low profile $\frac{3}{8}$ inch chain run on a small nose bar. Curve C represents the kickback of a chain made in accordance with my invention and run on a small nose bar whereas curve D represents the kickback results of my chain run on a standard sprocket nose bar. It can be seen that the kickback is substantially less and virtually eliminated on my saw chain in comparison with the standard low profile chain irrespective of the nose bar employed. In addition, field tests with my chain have demonstrated an improved stability and smoother operation. Field tests have also demonstrated that cutting efficiency is generally comparable to the standard low profile $\frac{3}{8}$ inch pitch chain. Finally, a substantial advantage results during the boring operation where boring can be performed with my new chain whereas the standard safety chain including a protective link cannot effectively and safely be employed for boring.

Figure 9:
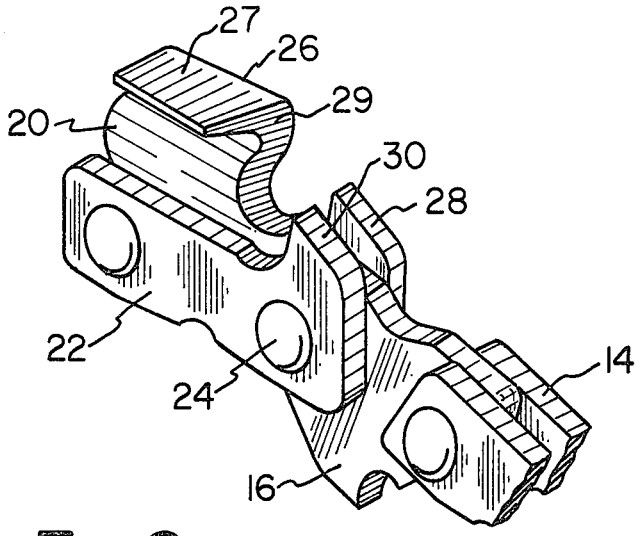
FIG. 9 is a perspective view of dual depth gauges without a sloping center drive link.

A saw chain having a dual depth gauge without the specially configured center drive link also reduces kickback over the standard chain. Such a chain section is illustrated in FIG. 9. The cutter tie strap 22 and the cutter link 20 are identical with the embodiment illustrated in FIG. 2. The only difference in the chain is that the center drive link which precedes the cutter pair is a conventional center drive link 16 instead of the specially configured link 18.

Tests have been conducted on a standard $\frac{3}{8}$ inch pitch chain (no safety link) having a single depth gauge without a ramped surface. The maximum kickback was on the order of 410 to 440 inch pounds. A cutter tie strap having a similar depth gauge was added as in FIG. 9 and the chain had a maximum kickback of 210 inch pounds. A center drive link with a third depth gauge was added and the kickback was reduced to a maximum of 110 inch pounds.

Finally, a cutter link with a ramped depth gauge was tested and compared with a chain having the same cutter link and a mating tie link with a comparable depth gauge. The chain was tested at a kickback of 260 inch pounds with the single depth gauge and 105 inch pounds with the dual depth gauges. It, therefore, can be seen from all of the above results that increasing the facial area through dual depth gauges reduces kickback and adding a third depth gauge via a center drive link reduces kickback even more.

I claim:

1. In an endless safety saw chain for cutting wood including a plurality of center links and a plurality of pairs of side links pivotally joining said center links and defining a saw chain width with certain of said side links being cutter links, the improvement comprising a depth gauge means associated with said cutter links having a coincident facial area for engaging the wood substantially equal to the saw chain width.

2. In an endless safety saw chain including a plurality of center links and a plurality of pairs of side links pivotally joining said center links, certain of said pairs of side links being cutter pairs comprising a noncutting tie link on one side and a cutter link on the other side of the center link, the improvement comprising the noncutting tie link, the cutter link and the center link each including a depth gauge, the center link depth gauge defined by an upwardly and rearwardly sloping surface positioned to extend between the depth gauges of the noncutting tie link and cutter link when the chain is in a flat position so as to position said three depth gauges in side by side relationship.

3. The improvement of claim 1, said sloping surface terminating at a peak slightly less than the height of the peak of said depth gauges when the chain is in the flat position.

4. The improvement of claim 4, said sloping surface having a slope more gradual than a slope of the depth gauges when the chain is in the flat position.

5. The improvement of claim 5, said sloping surface starting at a position forward of the cutter pairs at substantially a vertical center line of the center link.

6. The improvement of claim 2 each of the depth gauges including a gullet positioned to form a coincident opening to permit sharpening of the cutter link.

7. The improvement of claim 3 wherein the center link is a drive link.

8. An endless safety saw chain for operation about a chain saw bar comprising in sequence:

A. a pair of side links, one of side links being a cutter link having a cutter portion and a sloping depth gauge and the other of said side links being a non-cutting link and having a sloping depth gauge in substantial alignment with said cutter link depth gauge;

B. a center drive link pivotally connected to the pair of side links and including an upwardly and rearwardly sloping surface positioned to extend between said depth gauges of said pair of side links.

C. a pair of side links comprising tie straps pivotally connected to the center drive links;

D. a center drive link pivotally connected to said pair of tie straps and to another pair of said side links including a cutter link.

9. The saw chain of claim 8 wherein the sloping surface of the center drive link has a more gradual slope than that of the depth gauges and terminates in a peak having a height slightly less than the height of the depth gauges when the chain is in the flat position so that the center drive link sloping surface assumes the same profile as the depth gauges as the chain articulates about a nose of the chain saw bar.

* * * * *

UNITED STATES PATENT AND TRADEMARK OFFICE

CERTIFICATE OF CORRECTION

PATENT NO. : 4,348,927

DATED : September 14, 1982

INVENTOR(S) : Jaroslav Jiri Olmr

It is certified that error appears in the above-identified patent and that said Letters Patent are hereby corrected as shown below:

Column 1 Lines 37 & 38 "chain saw" should read --saw chain--.

Claim 4 - Column 4 Line 66 "Claim 4" should read --Claim 3--.

Claim 5 - Column 5 Line 1 "Claim 5" should read --Claim 4--.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*